US008559664B2

(12) United States Patent
Inoda et al.

(10) Patent No.: US 8,559,664 B2
(45) Date of Patent: Oct. 15, 2013

(54) MICROPHONE UNIT

(75) Inventors: Takeshi Inoda, Daito (JP); Ryusuke Horibe, Daito (JP); Fuminori Tanaka, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 651 days.

(21) Appl. No.: 12/691,250

(22) Filed: Jan. 21, 2010

(65) Prior Publication Data

US 2010/0189300 A1 Jul. 29, 2010

(30) Foreign Application Priority Data

Jan. 28, 2009 (JP) ..... 2009-016948

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| *H04R 1/02* | (2006.01) |

(52) U.S. Cl.
USPC ..... 381/361; 381/91; 381/357; 381/360

(58) Field of Classification Search
USPC ..... 381/91, 357, 360, 361; 379/433.03
See application file for complete search history.

(56) References Cited

U.S. PATENT DOCUMENTS

2006/0128444 A1 * 6/2006 Toki et al. ..... 455/569.2

FOREIGN PATENT DOCUMENTS

| | | | |
|---|---|---|---|
| CN | 101 247 669 | A | 8/2008 |
| DE | 42 29 450 | C1 | 12/1993 |
| EP | 0 493 361 | A2 | 7/1992 |
| JP | 3601900 | B2 | 10/2004 |
| JP | 2008-48329 | A | 2/2008 |
| JP | 2008-219238 | A | 9/2008 |
| WO | WO 00/49789 | * | 8/2000 |

OTHER PUBLICATIONS

Extended European Search Report dated Sep. 14, 2012 (8 pages).

* cited by examiner

*Primary Examiner* — Duc Nguyen
*Assistant Examiner* — Matthew Eason
(74) *Attorney, Agent, or Firm* — Crowell & Moring LLP

(57) ABSTRACT

A microphone unit comprises a microphone, leg members and a base. The microphone comprises a diaphragm for detecting sound and a housing for containing the diaphragm. The leg members project outwardly from a rear wall of the housing, and are provided near a second through-hole which connects a second inner space to outer space. The base is connected to the leg members to form a gap between the housing and the base. When the microphone unit thus formed in a simple structure and reduced thickness is mounted in a product, the gap allows the outer space to be connected to the second inner space through the second through-hole, making it possible to efficiently guide sound to the second inner space and obtain good differential characteristics.

16 Claims, 6 Drawing Sheets

MICROPHONE UNIT

BACKGROUND OF THE INVENTION

1. Field of the Invention

The present invention relates to a microphone unit which can be effectively mounted and used in e.g. an electrical or electronics product (hereafter referred to simply as product) such as a mobile phone or a hearing aid, and which detects sound (i.e. vibration of air) and converts the detected sound to an electrical signal for output.

2. Description of the Related Art

A microphone unit is known which has a vibratory diaphragm to be vibrated by sound so as to detect the sound by the vibration of the vibratory diaphragm. One of the microphone units of this kind is designed to guide the sound to both front and rear surfaces of the vibratory diaphragm. In such a microphone unit, the vibratory diaphragm is vibrated by the difference between the sound guided to the front surface and the sound guided to the rear surface of the vibratory diaphragm (i.e. difference in phase and amplitude of the vibration waves of air), whereby the sound is detected by the vibration of the vibratory diaphragm. Such a microphone unit is called a differential type microphone unit.

One of such known differential type microphone units has a housing and a vibratory diaphragm provided in the housing so that the inner space of the housing is divided into a first inner space (space on the front surface side of the vibratory diaphragm) and a second inner space (space on the rear surface side of the vibratory diaphragm), and that the front wall of the housing (wall facing the front surface of the vibratory diaphragm) has a first through-hole formed therein to connect the first inner space and an outer space outside the housing, while the rear wall of the housing (wall facing the rear surface of the vibratory diaphragm) has a second through-hole formed therein to connect the second inner space and the outer space outside the housing. In such a differential type microphone unit, sound is guided from the outer space through the first through-hole to the first inner space (i.e. the front surface of the vibratory diaphragm), while the sound is also guided from the outer space through the second through-hole to the second inner space (i.e. the rear surface of the vibratory diaphragm).

However, there is a problem that it is not suitable to mount and use the conventional differential type microphone unit in e.g. a product such as a mobile phone or a hearing aid. More specifically, assuming that the product has a sound receiving opening, and that the conventional microphone is mounted in the product to allow the first through-hole in the front wall of the housing of the microphone to face the sound receiving opening, there is a possibility that the second through-hole in the rear wall of the housing is occluded by some components in the product. If the second through-hole is occluded, it is not possible to effectively guide the sound to the second inner space (to the rear surface of the vibratory diaphragm), making it impossible to obtain good differential characteristics and reducing the quality of the microphone.

There are other known microphone units in the art. For example, Japanese Laid-open Patent Publication 2008-48329 discloses a microphone unit having a circuit board and a vibratory diaphragm supported by a support to the circuit board, in which the support has a leg member, while a space is formed between the vibratory diaphragm and the circuit board. Japanese Laid-open Patent Publication 2008-219238 discloses a microphone unit having a vibratory diaphragm supported by a support ring in a unit case, in which the support ring has a leg member, and a space is formed between the vibratory diaphragm and the unit case. Further, Japanese Patent 3601900 discloses a microphone unit having a housing in which a cylindrical tube-shaped rib for inserting a differential microphone is provided. However, these known microphone units do not solve the above problem.

SUMMARY OF THE INVENTION

An object of the present invention is to provide a high quality microphone unit which is simple in structure with a reduced thickness, and which makes it possible to obtain good differential characteristics even when mounted in a product.

According to the present invention, this object is achieved by a microphone unit comprising: a vibratory diaphragm for detecting sound; a housing having an inner space for containing the vibratory diaphragm; at least one leg member projecting outwardly from the housing; and a base connected to the at least one leg member. The vibratory diaphragm divides the inner space of the housing into a first inner space and a second inner space. The housing has a first through-hole formed therein to connect the first inner space and an outer space outside the housing and a second through-hole formed therein to connect the second inner space and the outer space. The at least one leg member is provided near the second through-hole. Further, a gap to connect the second inner space and the outer space through the second through-hole is formed between the housing and the base or between the base and a part of the at least one leg member.

According to the microphone unit of the present invention when mounted in a product such as a mobile phone or a hearing aid, the gap formed between the housing and the base or between the base and a part of the at least one leg member allows the outer space to be connected to the second inner space through the second through-hole. Thus, even when mounted in the product, the microphone unit makes it possible to efficiently guide sound to the second inner space through the gap formed between the housing and the base or between the base and the part of the at least one leg member, thereby obtaining good differential characteristics. Furthermore, the gap can be formed in a simple structure and a reduced thickness by connecting the at least one leg member provided near the second through-hole to the base. This makes it possible to achieve a high quality microphone unit which is simple in structure with a reduced thickness, and to obtain good differential characteristics even when mounted in a product.

Preferably, the at least one leg member is a plurality of leg members having the same length, in which the gap is formed between the housing and the base.

Preferably, the at least one leg member is a plurality of leg members which surround an area including the second through-hole and have different lengths, with a long part and a short part of the leg members, in which the gap is formed between the base and the short part of the leg members.

Preferably, the gap has a length of at least 0.15 mm.

Preferably, the microphone unit further comprises a cover for covering the housing in which the cover has a first opening and a second opening formed therein. Here, in a space covered by the cover, a first sound path is formed which connects the first through-hole and the first opening, and a second sound path is also formed which is independent of the first sound path and connects the second through-hole and the second opening.

Preferably, the cover includes a plane portion, in which the first opening and the second opening are formed in the plane portion.

Preferably, the microphone unit further comprises a cover for covering the housing in which the base has a first opening and a second opening formed therein. In a space covered by the cover here, a first sound path is formed which connects the first through-hole and the first opening, and a second sound path is also formed which is independent of the first sound path and connects the second through-hole and the second opening.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein:

FIG. 1A is a schematic cross-sectional view of a microphone unit according to a first embodiment of the present invention, taken along line X-X' of FIG. 1B, while

FIG. 4A is a schematic cross-sectional view of a microphone unit according to a third embodiment of the present invention, taken along line X-X' of FIG. 4B, while

DESCRIPTION OF THE PREFERRED EMBODIMENTS

Figure 1A:
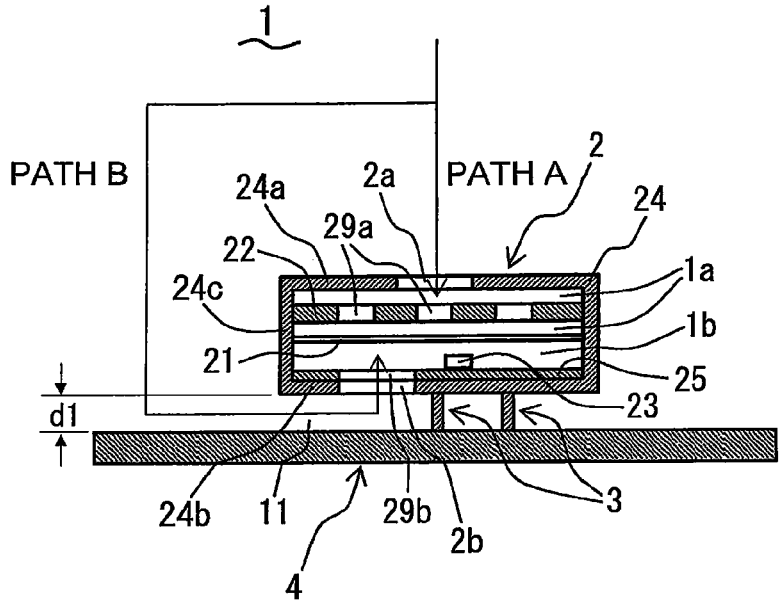

Embodiments of the present invention, as best mode for carrying out the invention, will be described hereinafter with reference to the drawings. The present invention relates to a microphone unit. It is to be understood that the embodiments herein are not intended as limiting, or encompassing the entire scope of, the invention. Note that like parts are designated by like reference numerals or characters throughout the drawings.

(First Embodiment)

Figure 1B:
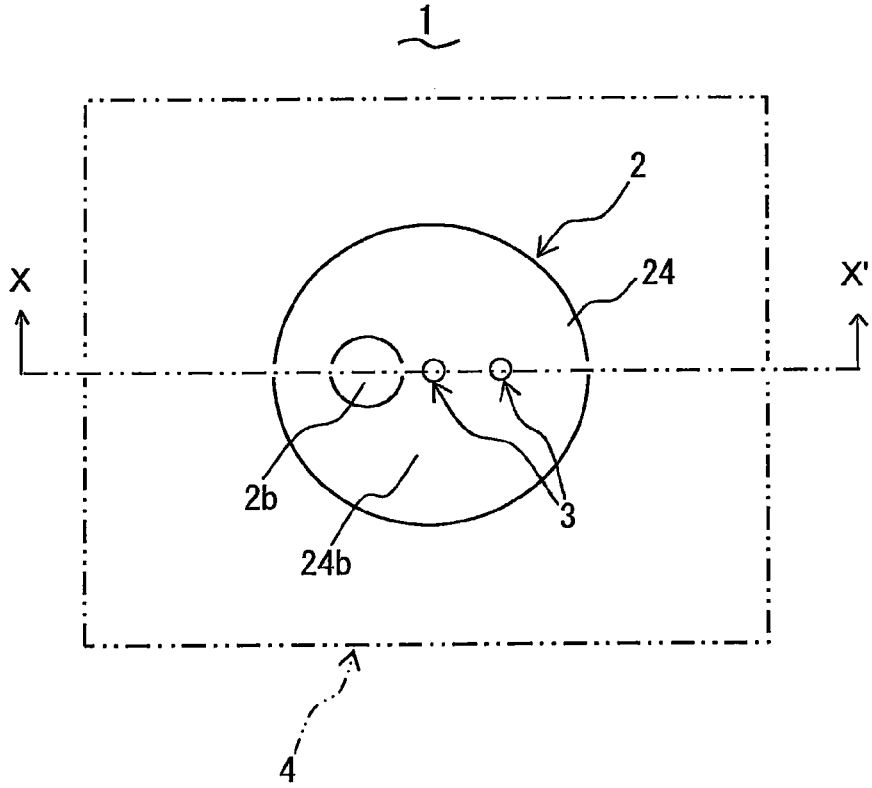
FIG. 1B is a schematic bottom view of the microphone unit.

A microphone unit 1 according to a first embodiment of the present invention will be described with reference to FIG. 1A and FIG. 1B. FIG. 1A is a schematic cross-sectional view of the microphone unit 1 according to the first embodiment, taken along line X-X' of FIG. 1B, while FIG. 1B is a schematic bottom view of the microphone unit 1. The microphone unit 1 is mounted and used in a product such as a mobile phone or a hearing aid, and detects sound propagating in air (i.e. vibration of air), and further converts the detected sound to an electrical signal for output. The microphone unit 1 comprises a microphone 2 for detecting sound and converting the detected sound to an electrical signal, and also comprises leg members (at least one leg member) 3, a base 4 and so on for securing a guide path to guide the sound to the microphone 2. The microphone 2 comprises: a vibratory diaphragm 21 and a back electrode 22 for detecting sound; a signal processing circuit 23 for converting the sound detected by the vibratory diaphragm 21 and the back electrode 22 to an electrical signal; a housing 24 having an inner space for containing the vibratory diaphragm 21, the back electrode 22, the signal processing circuit 23; and so on.

The microphone unit 1 detects sound from the vibration of the vibratory diaphragm 21. The microphone unit 1 is of a differential type such that sound is guided to both front surface and rear surface of the vibratory diaphragm 21, and that the sound is detected from a vibration of the vibratory diaphragm 21 caused by a difference between the sound guided to the front surface and the sound guided to the rear surface of the vibratory diaphragm 21 (i.e. difference in phase and amplitude of the vibration waves of air). Further, the microphone unit 1 is of an electret condenser type such that an electret (dielectric having residual polarization) is used as the vibratory diaphragm 21 which, together with the back electrode 22, forms a capacitor, and that the vibration of the vibratory diaphragm 21 is detected by a change in electrostatic capacitance of the capacitor, and the detected vibration of the vibratory diaphragm 21 (i.e. detected sound) is converted to an electrical signal.

The housing 24 is cylindrical tube-shaped, and has a disk-shaped front wall 24*a*, a disk-shaped rear wall 24*b* facing and parallel to the front wall 24*a*, and a peripheral side wall 24*c* contiguous to the front wall 24*a* and the rear wall 24*b*. The vibratory diaphragm 21 is provided in the housing 24 so as to be parallel to the front wall 24*a* and the rear wall 24*b* of the housing 24. Further, the vibratory diaphragm 21 divides an inner space of the housing 24, which is a space inside the housing 24, into two parts: a first inner space 1*a* which is a space on the front side of the vibratory diaphragm 21 (on the side of the front wall 24*a* of the housing 24); and a second inner space 1*b* which is a space on the rear side of the vibratory diaphragm 21 (on the side of the rear wall 24*b* of the housing 24). The housing 24 has a first through-hole 2*a* formed therein through the front wall 24*a* to connect the first inner space 1*a* and the outer space which is a space outside the housing 24, while the housing 24 has a second through-hole 2*b* formed therein through the rear wall 24*b* to connect the second inner space 1*b* and the outer space outside the housing 24.

The back electrode 22 is provided in the first inner space 1*a* so as to be parallel to the vibratory diaphragm 21. The back electrode 22 has multiple electrode holes 29*a* formed therethrough. The signal processing circuit 23 is mounted on a circuit board 25 which is provided in the second inner space 1*b*. More specifically, the circuit board 25 is placed on the rear wall 24*b* of the housing 24, and has formed therethrough a board hole 29*b* at a position corresponding to the second through-hole 2*b*. The signal processing circuit 23 is electrically connected to the back electrode 22 by a conductive wire (not shown). Note that the arrangement of the vibratory diaphragm 21 and the back electrode 22 is not limited to that described above, and, for example, can be reversely arranged (to place the back electrode 22 in the second inner space 1*b*) as long as the arrangement allows a change in electrostatic capacitance to be detected.

The vibratory diaphragm 21 is formed of an electret (dielectric having residual polarization), while the back electrode 22 is made of a conductor. Thus, the vibratory diaphragm 21 and the back electrode 22 form a capacitor which changes in electrostatic capacitance with a change(s) in distance between the vibratory diaphragm 21 and the back electrode 22 when the vibratory diaphragm 21 is vibrated by sound. Accordingly, the vibratory diaphragm 21 and the back electrode 22 serve to detect sound from the vibration of the vibratory diaphragm 21, and to output the detected sound as a change in electrostatic capacitance. The signal processing circuit 23 detects the vibration of the vibratory diaphragm 21 from the change in electrostatic capacitance, and converts the detected vibration of the vibratory diaphragm 21 (i.e. sound detected by the vibratory diaphragm 21) to an electrical signal.

The leg members (at least one leg member) 3 are provided on the rear wall 24*b* of the housing 24 so as to project outwardly from the housing 24. The leg members 3 are provided near the second through-hole 2*b*. In the present embodiment, a plurality of leg members 3, more specifically, two leg members 3 are provided, and have the same length. The leg members 3 each have an end connected or joined to the base 4 e.g. by bonding so that a gap 11 to connect the second inner space 1*b* and the outer space through the second through-hole 2*b* is formed between the rear wall 24*b* of the housing 24 and the base 4 (between the microphone 2 and the base 4). In the present embodiment, the length d1 of the gap 11 (distance between the base 4 and the rear wall 24*b* of the housing 24) is 0.15 mm. Note that a conductive wire (not shown) for outputting an electrical signal converted and output from the signal processing circuit 23 is formed on the base 4 and at least one of the leg members 3.

In the microphone unit 1 of the present embodiment, sound from a sound source outside the housing 24 (outside the microphone 2) is guided through the first through-hole 2*a* (as schematically indicated by path A) to the first inner space 1*a* (i.e. to the front surface of the vibratory diaphragm 21), and is also guided through the gap 11 formed between the housing 24 and the base 4 and through the second through-hole 2*b* (as schematically indicated by path B) to the second inner space 1*b* (i.e. to the rear surface of the vibratory diaphragm 21). Then, the vibratory diaphragm 21 is vibrated by a difference between the sound guided to the first inner space 1*a* and the sound guided to the second inner space 1*b* (i.e. difference in phase and amplitude of the vibration waves of air), whereby the sound is detected by the vibration of the vibratory diaphragm 21.

Figure 2:
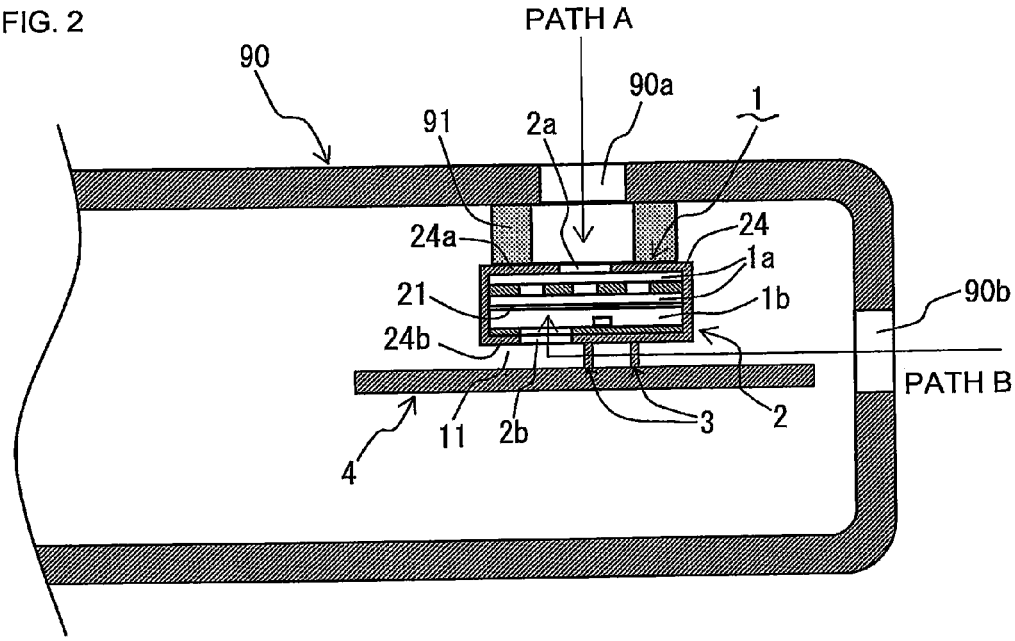
FIG. 2 is a schematic cross-sectional view showing an example of mounting the microphone unit in a product.

FIG. 2 is a schematic cross-sectional view showing an example of mounting the microphone unit 1 of the present embodiment in a product 90 such as a mobile phone or a hearing aid. As shown in FIG. 2, the microphone unit 1 of the present embodiment is mounted in the product 90, for example, to allow the first through-hole 2*a* in the front wall 24*a* of the housing 24 to face a sound receiving opening 90*a* of the product 90, and also allow the gap 11 formed between the housing 24 and the base 4 to face a sound receiving opening 90*b* of the product 90. Here, a sound leakage preventing rubber 91 having a tubular shape with a hollow is used to connect the first through-hole 2*a* and the sound receiving opening 90*a* so as to prevent sound leakage. With the microphone unit 1 of the present embodiment mounted in the product 90 in this manner, sound from the sound source is guided from the sound receiving opening 90*a* to the first inner space 1*a* through the hollow of the sound leakage preventing rubber 91 and the first through-hole 2*a*, and is also guided from the sound receiving opening 90*b* to the second inner space 1*b* through the gap 11 formed between the housing 24 and the base 4 and through the second through-hole 2*b*.

According to the microphone unit 1 of the present embodiment when mounted in the product 90, the gap 11 formed between the housing 24 and the base 4 allows the outer space to be connected to the second inner space 1*b* through the sound receiving opening 90*b* and the second through-hole 2*b*. Thus, even when mounted in the product 90, the microphone unit 1 makes it possible to efficiently guide sound to the second inner space 1*b* (i.e. to the rear surface of the vibratory diaphragm 21) through the gap 11 formed between the housing 24 and the base 4, thereby obtaining good differential characteristics. Furthermore, the gap 11 can be formed in a simple structure and a reduced thickness by connecting the leg members 3 provided near the second through-hole 2*b* to the base 4. This makes it possible to achieve a high quality microphone unit 1 which is simple in structure with a reduced thickness, and to obtain good differential characteristics even when mounted in a product 90.

Furthermore, the length d1 of the gap 11 of 0.15 mm makes it possible to efficiently guide sound to the second inner space 1*b* while achieving a reduced thickness of the microphone unit 1, thereby obtaining good differential characteristics. Note that the length d1 can be as short as 0.1 mm minimum to achieve a minimum sufficient level of efficiency to guide sound to the second inner space 1*b* with a reduced thickness of the microphone unit 1 and obtain good differential characteristics. If the length d1 is shorter than 0.1 mm, there is a possibility that the acoustic characteristics including the differential characteristics may deteriorate. Thus, considering that the effective length of the gap 11 may be shortened by dust or dirt, the length d1 of the gap 11 is preferably at least 0.15 mm to efficiently guide sound to the second inner space 1*b* with a reduced thickness and good differential characteristics of the microphone unit 1.

(Second Embodiment)

Figure 3:
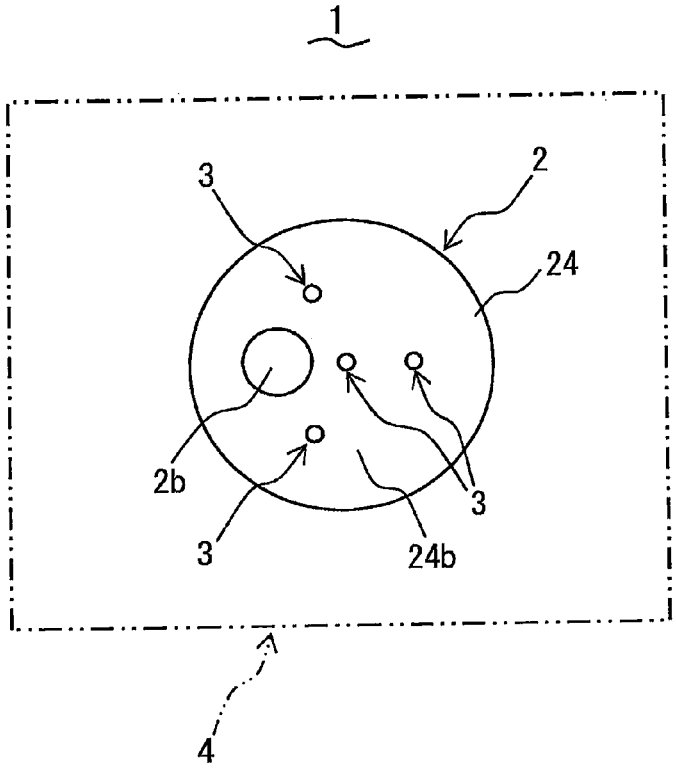
FIG. 3 is a schematic bottom view of the microphone unit of according to a second embodiment of the present invention.

A microphone unit 1 according to a second embodiment of the present invention will be described with reference to FIG. 3, which is a schematic bottom view of the microphone unit 1 of the present embodiment. The microphone unit 1 of the present embodiment is the same as that of the first embodiment, except that four leg members 3 having the same length are provided here. The four leg members 3 each have an end connected to the base 4. The microphone unit 1 of the present embodiment has similar functions and effects to those of the microphone unit of the first embodiment.

(Third Embodiment)

Figure 4A:
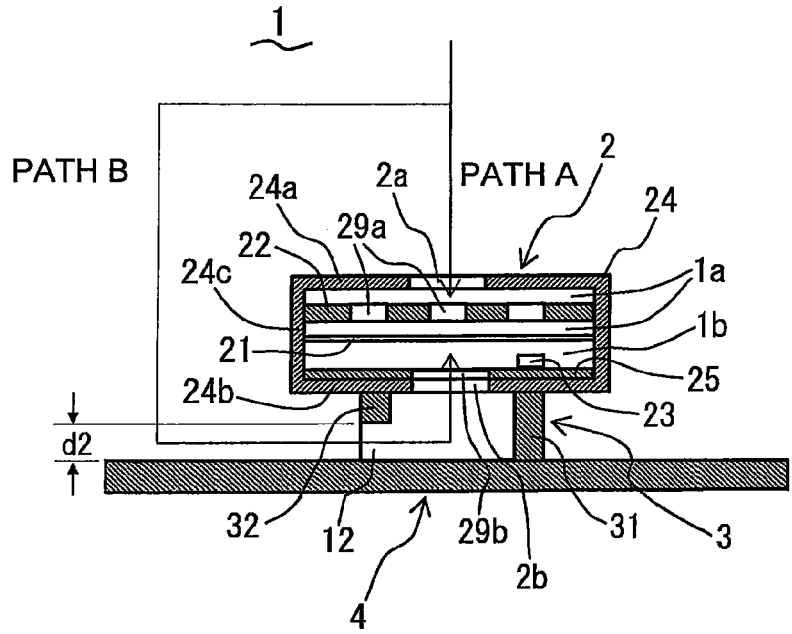
Figure 4B:
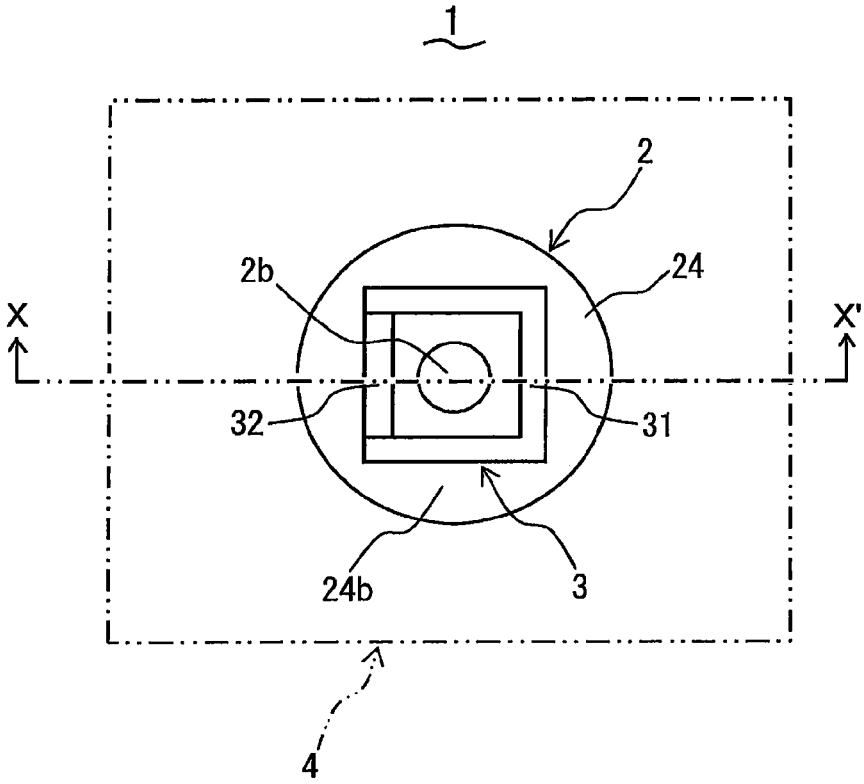
FIG. 4B is a schematic bottom view of the microphone unit.

A microphone unit 1 according to a third embodiment of the present invention will be described with reference to FIG. 4A and FIG. 4B. FIG. 4A is a schematic cross-sectional view of the microphone unit 1 according to the third embodiment, taken along line X-X' of FIG. 4B, while FIG. 4B is a schematic bottom view of the microphone unit 1. The microphone unit 1 of the present embodiment is the same as that of the first embodiment, except that the present embodiment uses leg members 3 which are different from those of the first embodiment. More specifically, the leg members 3 of the present embodiment form a frame shape which surrounds a rectangular area, including the second through-hole 2*b*, of the rear wall 24*b*.

Further, the leg members 3 have different lengths (two parts of different lengths). More specifically, the leg members 3 are formed of a long leg member 31 (one part) which has a substantially U-shape (square-cornered U-shape), as seen in plan view, corresponding to three sides of the rectangular area, and a short leg member 32 (the other part) corresponding to the other side of the rectangular area. The long leg member 31 has a substantially U-shaped end connected or joined to the base 4 e.g. by bonding. In the microphone unit 1 of the present embodiment, the end of the long leg member 31 of the leg members 3 is connected to the base 4 so that a gap 12 to connect the second inner space 1*b* and the outer space through the second through-hole 2*b* is formed between the base 4 and the short leg member 32 of the leg members 3. In the present embodiment, the length d2 of the gap 12 (distance between the base 4 and the short leg member 32 of the leg members 3) is 0.15 mm.

In the microphone unit 1 of the present embodiment, sound from a sound source outside the housing 24 (outside the microphone 2) is guided through the first through-hole 2*a* (as schematically indicated by path A) to the first inner space 1*a* (i.e. to the front surface of the vibratory diaphragm 21), and is also guided through the gap 12 formed between the base 4 and the short leg member 32 of the leg members 3 and through the second through-hole 2*b* (as schematically indicated by path B) to the second inner space 1*b* (i.e. to the rear surface of the vibratory diaphragm 21). Then, the vibratory diaphragm 21 is vibrated by a difference between the sound guided to the first inner space 1*a* and the sound guided to the second inner space 1*b* (i.e. difference in phase and amplitude of the vibration waves of air), whereby the sound is detected by the vibration of the vibratory diaphragm 21. The microphone unit 1 of the present embodiment is mounted, for example, in a product 90 similarly as for the microphone unit 1 of the first embodiment.

According to the microphone unit 1 of the present embodiment when mounted in the product 90, the gap 12 formed between the base 4 and the short leg member 32 of the leg members 3 allows the outer space to be connected to the second inner space 1*b* through the sound receiving opening 90*b* and the second through-hole 2*b*. Thus, even when mounted in the product 90, the microphone unit 1 makes it possible to efficiently guide sound to the second inner space 1*b* (i.e. to the rear surface of the vibratory diaphragm 21) through the gap 12 formed between the base 24 and the short leg member 32 of the leg members 3, thereby obtaining good differential characteristics. Furthermore, the gap 12 can be formed in a simple structure with a reduced thickness by connecting the leg members 3 provided near the second through-hole 2*b* to the base 4. This makes it possible to achieve a high quality microphone unit 1 which is simple in structure with a reduced thickness, and to obtain good differential characteristics even when mounted in a product 90. For the same reason as described for the length d1 of the gap 11 in the first embodiment, the length d2 of the gap 12 of at least 0.1 mm, preferably at least 0.15 mm, makes it possible to efficiently guide sound to the second inner space 1*b* so as to obtain good differential characteristics while achieving a reduced thickness of the microphone unit 1.

(Fourth Embodiment)

Figure 5:
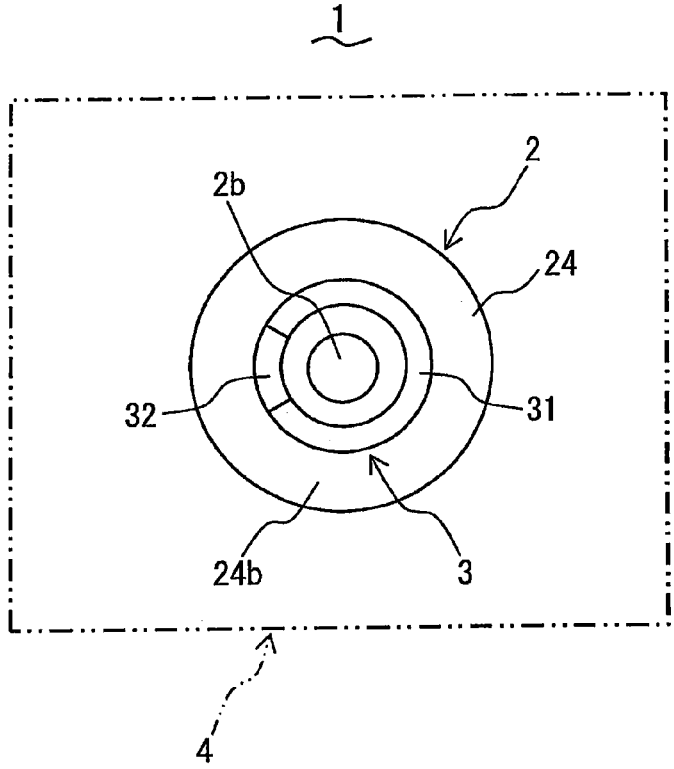
FIG. 5 is a schematic bottom view of a microphone unit according to a fourth embodiment of the present invention.

A microphone unit 1 according to a fourth embodiment of the present invention will be described with reference to FIG. 5, which is a schematic bottom view of the microphone unit 1 of the present embodiment. The microphone unit 1 of the present embodiment is the same as that of the third embodiment, except that the leg members 3 of the present embodiment forming a frame shape surround a circular area, including the second through-hole 2*b*, of the rear wall 24*b*, in which the leg members 3 are formed of a long leg member 31 and a short leg member 32 which have a circular C-shape and an arc shape as seen in plan view, respectively, to correspond to the circumference of the circular area, and the C-shaped long leg member 31 has an end connected or joined to the base 4 e.g. by bonding. The microphone unit 1 of the present embodiment has similar functions and effects to those of the microphone unit of the third embodiment.

(Fifth Embodiment)

Figure 6:
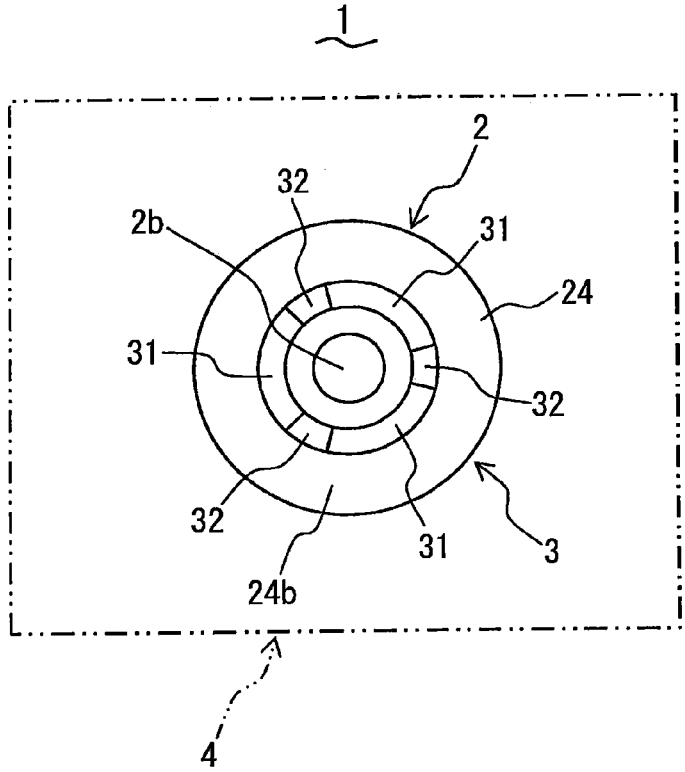
FIG. 6 is a schematic bottom view of a microphone unit according to a fifth embodiment of the present invention.

A microphone unit 1 according to a fifth embodiment of the present invention will be described with reference to FIG. 6, which is a schematic bottom view of the microphone unit 1 of the present embodiment. The microphone unit 1 of the present embodiment is the same as that of the fourth embodiment, except that the leg members 3 of the present embodiment which form a frame shape and surround a circular area, including the second through-hole 2*b*, of the rear wall 24*b*, are formed of alternate three long leg members 31 and three short leg member 32 which have an arc shape as seen in plan view, respectively, to correspond to the circumference of the circular area, and the arc-shaped long leg members 32 each has an end connected or joined to the base 4 e.g. by bonding. The microphone unit 1 of the present embodiment has similar functions and effects to those of the microphone unit of the fourth embodiment.

(Sixth Embodiment)

Figure 7:
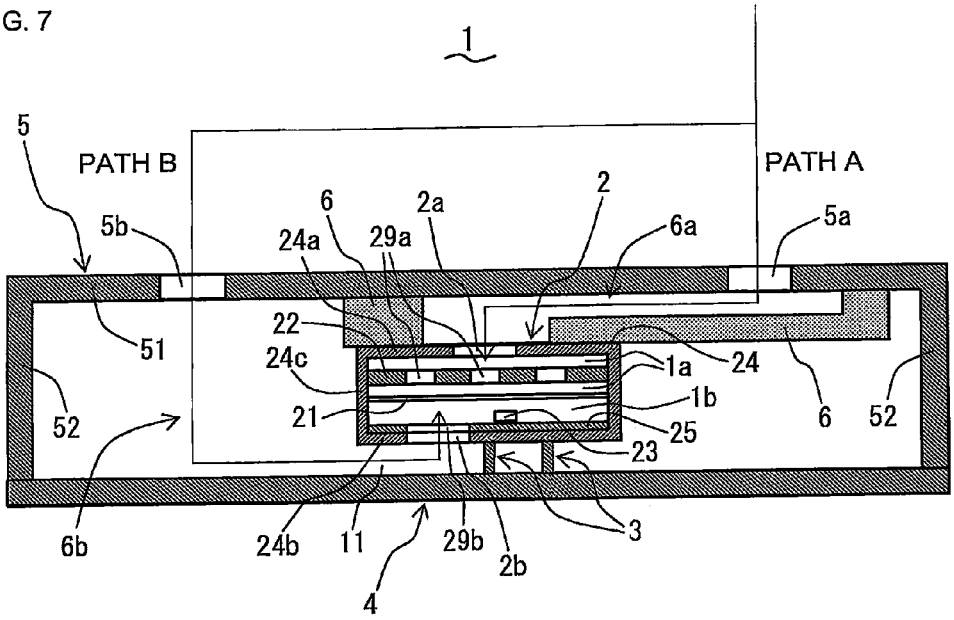
FIG. 7 is a schematic cross-sectional view of a microphone unit according to a sixth embodiment of the present invention.

A microphone unit 1 according to a sixth embodiment of the present invention will be described with reference to FIG. 7, which is a schematic cross-sectional view of the microphone unit 1 of the present embodiment. The microphone unit 1 of the present embodiment is the same as that of the first embodiment, except that it further comprises a cover 5 for covering the housing 24 (microphone 2), the leg members 3 and the base 4, in which the cover 5 has a first opening 5*a* and a second opening 5*b* (and a sound path-forming member (members) 6 described later) formed therein. The cover 5 includes a top wall (i.e. plane portion) 51 and standing walls 52 perpendicular to the top wall 51. The first opening 5*a* and the second opening 5*b* are formed in the top wall 51 (i.e. the same plane of the cover 5).

In a space covered by the cover 5 (between the cover 5 and the base 4), there are formed a first sound path 6*a* which connects the first through-hole 2*a* and the first opening 5*a*, and a second sound path 6*b* which connects the second through-hole 2*b* and the second opening 5*b*. The cover 5 has an end (ends of the standing walls) connected to the entire peripheral end of the base 4. In addition, a sound path-forming member (members) 6 is provided in the space covered by the cover 5 (between the cover 5 and the base 4) so as to separate the space into two spatial regions: a spatial region including the first through-hole 2*a* and the first opening 5*a*; and a spatial region including the second through-hole 2*b* and the second opening 5*b*. The first sound path 6*a* is formed by one of the spatial regions (including the first through-hole 2*a* and the first opening 5*a*) separated by the sound path-forming member (members) 6, while the second sound path 6*b* is formed by the other spatial region (including the second through-hole 2*b* and the second opening 5*b*) separated by the sound path-forming member (members) 6. Due to the presence of the sound path-forming member (members) 6, the first sound path 6*a* and the second sound path 6*b* are independent of each other without being connected to each other.

In the microphone unit 1 of the present embodiment, sound from a sound source outside the cover 5 is guided through the first opening 5*a*, the first sound path 6*a* and the first through-hole 2*a* (as schematically indicated by path A) to the first inner space 1*a* (i.e. to the front surface of the vibratory diaphragm 21), and is also guided through the second opening 5*b*, the second sound path 6*b*, the gap 11 formed between the base 4 and housing 24, and the second through-hole 2*b* (as schematically indicated by path B) to the second inner space 1*b* (i.e. to the rear surface of the vibratory diaphragm 21). Then, the vibratory diaphragm 21 is vibrated by a difference between the sound guided to the first inner space 1*a* and the sound guided to the second inner space 1*b* (i.e. difference in phase and amplitude of the vibration waves of air), whereby the sound is detected by the vibration of the vibratory diaphragm 21.

Figure 8:
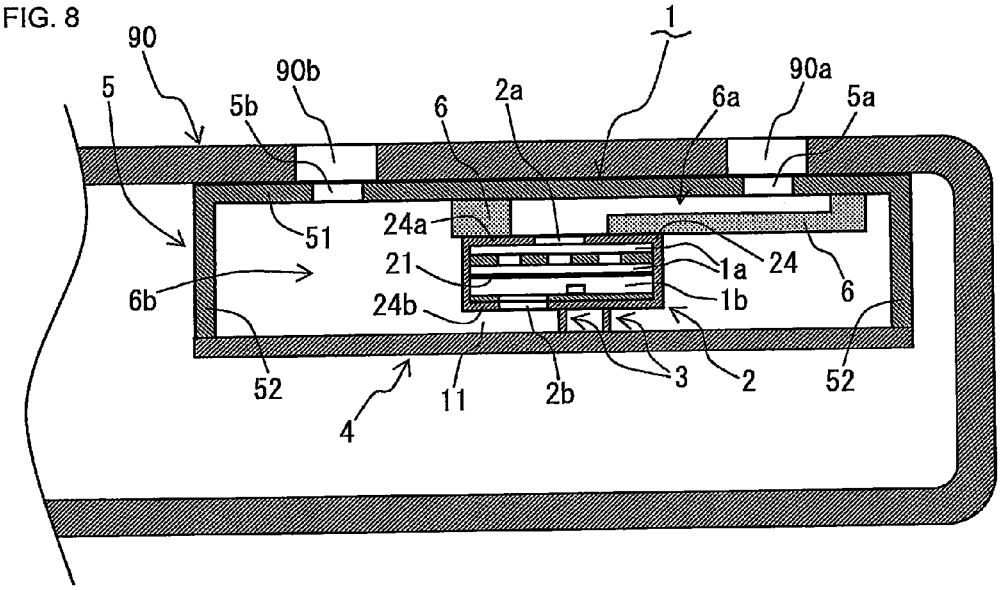
FIG. 8 is a schematic cross-sectional view showing an example of mounting the microphone unit in a product.

FIG. 8 is a schematic cross-sectional view showing an example of mounting the microphone unit 1 of the present embodiment in a product 90 such as a mobile phone or a hearing aid. As shown in FIG. 8, the microphone unit 1 of the present embodiment is mounted in the product 90, for example, to allow the first opening 5*a* of the cover 5 to face a sound receiving opening 90*a* of the product 90, and also allow the second opening 5*b* of the cover 5 to face a sound receiving opening 90*b* of the product 90. With the microphone unit 1 mounted in the product 90 in this manner, sound from the sound source is guided from the sound receiving opening 90*a* to the first inner space 1*a* through the first opening 5*a*, the first sound path 6*a* and the first through-hole 2*a*, and is also guided from the sound receiving opening 90*b* to the second inner space 1*b* through the second opening 5*b*, the second sound path 6*b*, the gap 11 formed between the housing 24 and the base 4, and the second through-hole 2*b*.

The microphone unit 1 of the present embodiment has similar functions and effects to those of the microphone unit of the first embodiment. In addition, in the microphone unit 1 of the present embodiment, the first sound path 6*a* connecting the first through-hole 2*a* of the housing 24 and the first opening 5*a* of the cover 5 is designed to be independent of the second sound path 6*b* connecting the second through-hole 2*b* of the housing 24 and the second opening 5*b* of the cover 5. This makes it possible to prevent interference between the sound guided to the first inner space 1*a* and the sound guided to the second inner space 1*b*, thereby obtaining good differential characteristics.

Furthermore, the first opening 5*a* and the second opening 5*b* are formed in the top wall 51 (i.e. the same plane of the cover 5). Thus, according to the microphone unit 1 of the present embodiment, when mounted in a product 90, a sound path passing through the inside of the product 90 for guiding sound from outside the product 90 to the first opening 5*a* and the second opening 5*b* can be prevented from becoming complex, preventing deterioration of the acoustic characteristics, and making it possible to reduce the thickness of the product 90. Note that the first opening 5*a* and the second opening 5*b* are not necessarily formed in the same plane of the cover 5, but can be formed in different planes of the cover 5. For example, the openings 5*a* and 5*b* can be formed in the mutually perpendicular planes of the cover 5, such that the first opening 5*a* is formed in the top wall 51 while the second opening 5*b* is formed in one of the standing walls 52. It is also possible to form the openings 5*a* and 5*b* in the mutually facing planes of the cover 5, such that the first opening 5*a* is formed in one of the standing walls 52 while the second opening 5*b* is formed in the opposite one of the standing walls 52.

(Seventh Embodiment)

Figure 9:
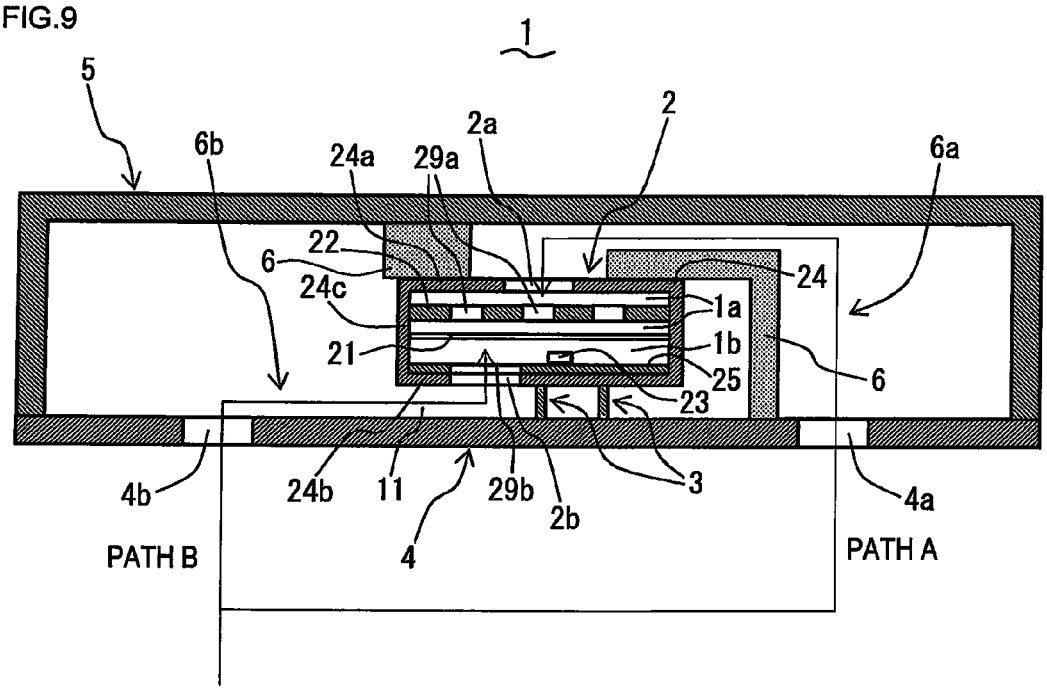
FIG. 9 is a schematic cross-sectional view of a microphone unit according to a seventh embodiment of the present invention.

A microphone unit 1 according to a seventh embodiment of the present invention will be described with reference to FIG. 9, which is a schematic cross-sectional view of the microphone unit 1 of the present embodiment. The microphone unit 1 of the present embodiment is the same as that of the first embodiment, except that it further comprises a cover 5 for covering the housing 24 (microphone 2), the leg members 3 and the base 4, in which the base 4 has a first opening 4*a* and a second opening 4*b* (and a sound path-forming member (members) 6 described later) formed therein. In a space covered by the cover 5 (between the cover 5 and the base 4), there are formed a first sound path 6*a* which connects the first through-hole 2*a* and the first opening 4*a*, and a second sound path 6*b* which connects the second through-hole 2*b* and the second opening 4*b*.

The cover 5 has an end (ends of its standing walls) connected to the entire peripheral end of the base 4. In addition, a sound path-forming member (members) 6 is provided in the space covered by the cover 5 (between the cover 5 and the base 4) so as to separate the space into two spatial regions: a spatial region including the first through-hole 2*a* and the first opening 4*a*; and a spatial region including the second through-hole 2*b* and the second opening 4*b*. The first sound path 6*a* is formed by one of the spatial regions (including the first through-hole 2*a* and the first opening 4*a*) separated by the sound path-forming member (members) 6, while the second sound path 6*b* is formed by the other spatial region (including the second through-hole 2*b* and the second opening 4*b*) separated by the sound path-forming member (members) 6. Due to the presence of the sound path-forming member (members) 6, the first sound path 6*a* and the second sound path 6*b* are independent of each other without being connected to each other.

In the microphone unit 1 of the present embodiment, sound from a sound source outside the cover 5 is guided through the first opening 4*a*, the first sound path 6*a* and the first through-hole 2*a* (as schematically indicated by path A) to the first inner space 1*a* (i.e. to the front surface of the vibratory diaphragm 21), and is also guided through the second opening 4*b*, the second sound path 6*b*, the gap 11 formed between the base 4 and housing 24, and the second through-hole 2*b* (as schematically indicated by path B) to the second inner space 1*b* (i.e. to the rear surface of the vibratory diaphragm 21). Then, the vibratory diaphragm 21 is vibrated by a difference between the sound guided to the first inner space 1*a* and the sound guided to the second inner space 1*b* (i.e. difference in phase and amplitude of the vibration waves of air), whereby the sound is detected by the vibration of the vibratory diaphragm 21.

Figure 10:
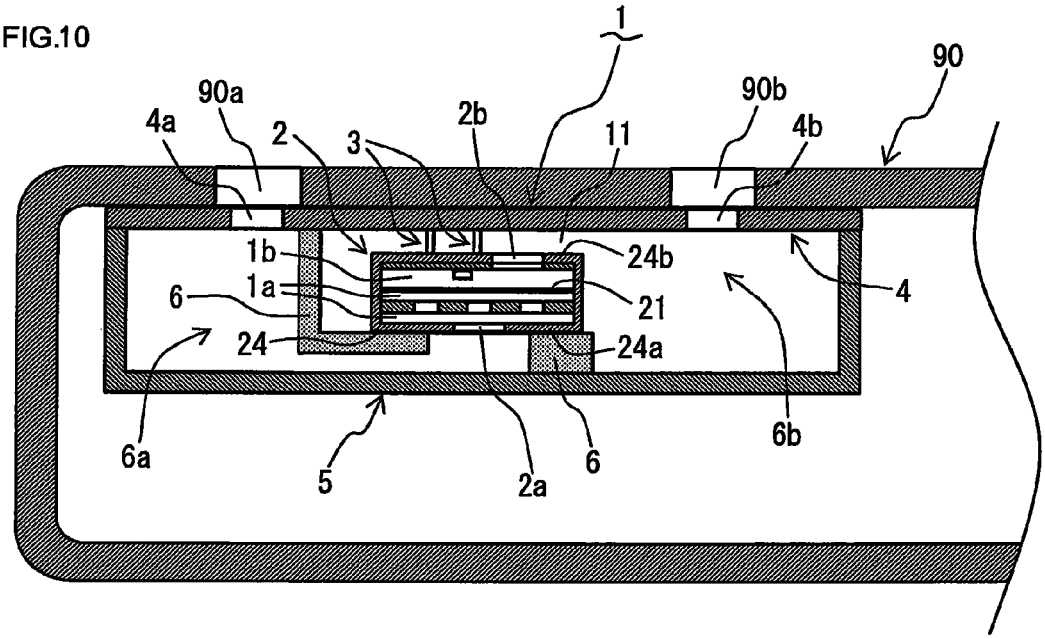
FIG. 10 is a schematic cross-sectional view showing an example of mounting the microphone unit in a product.

FIG. 10 is a schematic cross-sectional view showing an example of mounting the microphone unit 1 of the present embodiment in a product 90 such as a mobile phone or a hearing aid. As shown in FIG. 10, the microphone unit 1 according to the present embodiment is mounted in the product 90, for example, to allow the first opening 4*a* of the base 4 to face a sound receiving opening 90*a* of the product 90, and also allow the second opening 4*b* of the base 4 to face a sound receiving opening 90*b* of the product 90. With the microphone unit 1 of the present embodiment mounted in the product 90 in this manner, sound from the sound source is guided from the sound receiving opening 90*a* to the first inner space 1*a* through the first opening 4*a*, the first sound path 6*a* and the first through-hole 2*a*, and is also guided from the sound receiving opening 90*b* to the second inner space 1*b* through the second opening 4*b*, the second sound path 6*b*, the gap 11 formed between the housing 24 and the base 4, and the second through-hole 2*b*.

The microphone unit 1 of the present embodiment has similar functions and effects to those of the microphone unit of the first embodiment. In addition, in the microphone unit 1 of the present embodiment, the first sound path 6*a* connecting the first through-hole 2*a* of the housing 24 and the first opening 4*a* of the base 4 is designed to be independent of the second sound path 6*b* connecting the second through-hole 2*b* of the housing 24 and the second opening 4*b* of the base 4. This makes it possible to prevent interference between the sound guided to the first inner space 1*a* and the sound guided to the second inner space 1*b*, thereby obtaining good differential characteristics.

It is to be noted that the present invention is not limited to the above embodiments, and various modifications are possible within the spirit and scope of the present invention. For example, in the first embodiment described above, the number of the leg members can be only one. Further, in the sixth and seventh embodiments, the cover and the sound path-forming member (members) can be formed integrally with each other. Furthermore, in the first to seventh embodiments, the signal processing circuit can be provided on the base. Moreover, the present invention can be applied to not only a microphone unit of a type which detects the vibration of a vibratory diaphragm by a change in electrostatic capacitance, but also a microphone unit of, for example, a type which detects the vibration of a vibratory diaphragm by a distortion of the vibratory diaphragm.

The present invention has been described above using presently preferred embodiments, but such description should not be interpreted as limiting the present invention. Various modifications will become obvious, evident or apparent to those ordinarily skilled in the art, who have read the description. Accordingly, the appended claims should be interpreted to cover all modifications and alterations which fall within the spirit and scope of the present invention.

This application is based on Japanese patent application 2009-016948 filed Jan. 28, 2009, the content of which is hereby incorporated by reference.

What is claimed is:

1. A microphone unit comprising:

a vibratory diaphragm for detecting sound;

a housing having an inner space for containing the vibratory diaphragm;

at least one leg member projecting outwardly from the housing; and a base connected to the at least one leg member; and a cover for covering the housing in which the cover has a first opening and a second opening formed therein, wherein the vibratory diaphragm divides the inner space of the housing into a first inner space and a second inner space, wherein the housing has a first through-hole formed therein to connect the first inner space and an outer space outside the housing and a second through-hole formed therein to connect the second inner space and the outer space, wherein the at least one leg member is provided near the second through-hole, wherein the at least one leg member and the base secure a guide path to guide the sound to the vibratory diaphragm via the second inner space, wherein a gap to connect the second inner space and the outer space through the second through-hole is formed between the housing and the base or between the base and a part of the at least one leg member, wherein the guide path includes the gap, the second through-hole, and the second inner space, wherein in a space covered by the cover, a first sound path is formed which connects the first through-hole and the first opening, and a second sound path is also formed which is independent of the first sound path and connects the second through-hole and the second opening, and wherein the cover includes at least one plane portion, in which the first opening and the second opening are formed in the same plane portion.

2. The microphone unit according to claim 1, wherein the at least one leg member is a plurality of leg members having the same length, in which the gap is formed between the housing and the base.

3. The microphone unit according to claim 1, wherein the at least one leg member is a plurality of leg members which surround an area including the second through-hole and have different lengths, with a long part and a short part of the leg members, in which the gap is formed between the base and the short part of the leg members.

4. The microphone unit according to claim 1, wherein the gap has a length of at least 0.15 mm.

5. A microphone unit comprising:

a vibratory diaphragm for detecting sound;

a housing having an inner space for containing the vibratory diaphragm;

at least one leg member projecting outwardly from the housing;

a base connected to the at least one leg member; and a cover for covering the housing and the base in which the base has a first opening and a second opening formed therein, wherein the vibratory diaphragm divides the inner space of the housing into a first inner space and a second inner space, wherein the housing has a first through-hole formed therein to connect the first inner space and an outer space outside the housing and a second through-hole formed therein to connect the second inner space and the outer space, wherein the at least one leg member is provided near the second through-hole, wherein the at least one leg member and the base secure a guide path to guide the sound to the vibratory diaphragm via the second inner space, wherein a gap to connect the second inner space and the outer space through the second through-hole is formed between the housing and the base or between the base and a part of the at least one leg member, wherein the guide path includes the gap, the second through-hole, and the second inner space, and wherein in a space covered by the cover, a first sound path is formed which connects the first through-hole and the first opening, and a second sound path is also formed which is independent of the first sound path and connects the second through-hole and the second opening.

6. The microphone unit according to claim 5, wherein the at least one leg member is a plurality of leg members having the same length, in which the gap is formed between the housing and the base.

7. The microphone unit according to claim 5, wherein the at least one leg member is a plurality of leg members which surround an area including the second through-hole and have different lengths, with a long part and a short part of the leg members, in which the gap is formed between the base and the short part of the leg members.

8. The microphone unit according to claim 5, wherein the gap has a length of at least 0.15 mm.

9. The microphone unit according to claim 1 wherein a conductive wire for outputting an electrical signal is formed on the base.

10. The microphone unit according to claim 2, wherein a conductive wire for outputting an electrical signal is formed on the base.

11. The microphone unit according to claim 3, wherein a conductive wire for outputting an electrical signal is formed on the base.

12. The microphone unit according to claim 4, wherein a conductive wire for outputting an electrical signal is formed on the base.

13. The microphone unit according to claim 5, wherein a conductive wire for outputting an electrical signal is formed on the base.

14. The microphone unit according to claim 6, wherein a conductive wire for outputting an electrical signal is formed on the base.

15. The microphone unit according to claim 7, wherein a conductive wire for outputting an electrical signal is formed on the base.

16. The microphone unit according to claim 8, wherein a conductive wire for outputting an electrical signal is formed on the base.

* * * * *